US006047798A

United States Patent [19]

Lin

[11] Patent Number: 6,047,798

[45] Date of Patent: Apr. 11, 2000

[54] FOLDABLE SUITCASE HAVING RETRACTABLE HANDLE DEVICE

[76] Inventor: Chao Chin Lin, P.O. Box 63-99, Taichung, Taiwan, 406

[21] Appl. No.: 09/138,042

[22] Filed: Aug. 19, 1998

[51] Int. Cl.[7] ..... A45C 5/14; A45C 7/00; A45C 13/26

[52] U.S. Cl. ..... 190/18 A; 190/39; 190/103; 190/115; 16/115; 280/37

[58] Field of Search ..... 190/18 A, 39, 190/103–105, 115, 117; 16/115

[56] References Cited

U.S. PATENT DOCUMENTS

| | | | |
|---|---|---|---|
| 4,087,102 | 5/1978 | Sprague | 190/18 A X |
| 5,374,073 | 12/1994 | Hung-Hsin | 190/18 A X |
| 5,653,319 | 8/1997 | Wang | 190/18 A X |
| 5,664,652 | 9/1997 | Shamah | 190/105 X |
| 5,709,398 | 1/1998 | Lu | 190/18 A X |
| 5,713,441 | 2/1998 | Chen | 190/115 |
| 5,749,446 | 5/1998 | Hsieh | 190/115 X |
| 5,769,194 | 6/1998 | Chang | 190/18 A |
| 5,803,214 | 9/1998 | Wang | 190/115 |
| 5,819,891 | 10/1998 | Wang et al. | 190/18 A X |
| 5,829,558 | 11/1998 | Cheng | 190/18 A X |
| 5,836,052 | 11/1998 | Chou | 190/115 X |
| 5,901,822 | 5/1999 | Tu | 190/115 |

*Primary Examiner*—Sue A. Weaver

[57] ABSTRACT

A foldable luggage article has an upper portion and a wheel device secured to a base. A retractable handle device is secured to the upper portion of the luggage article for supporting luggage article at the expanded working position when the handle device is extended and at the folded position when the handle device is retracted. The handle device includes a pair of posts secured to the base and a pair of tubes slidably engaged on the posts and a pair of pipes slidably engaged in the posts for extending the length of the handle device. The posts may also be folded relative to the base.

2 Claims, 12 Drawing Sheets

FOLDABLE SUITCASE HAVING RETRACTABLE HANDLE DEVICE

BACKGROUND OF THE INVENTION

1. Field of the Invention

The present invention relates to a suitcase or a luggage article, and more particularly to a suitcase or a luggage article having a retractable handle device.

2. Description of the Prior Art

Typical foldable bags or suitcases or luggage article comprise a middle portion that may be folded to a compact size for storing purposes. However, no handle devices may be provided for such a foldable luggage article.

The present invention has arisen to mitigate and/or obviate the afore-described disadvantages of the conventional foldable bags.

SUMMARY OF THE INVENTION

The primary objective of the present invention is to provide a foldable luggage article having a handle device extendible when the luggage article is opened and retractable when the luggage article is folded.

In accordance with one aspect of the invention, there is provided a luggage article comprising a luggage body including a foldable structure for allowing the body to be expanded to a working position and to be folded to a folded position, the body including a base and an upper portion, a wheel device secured to the base of the body, and a retractable handle device secured to the upper portion of the body for supporting the body at the working position and at the folded position respectively, such that the luggage article includes a handle device extendible when the luggage article is opened and retractable when the luggage article is folded.

The body includes a foldable middle portion provided between the base and the upper portion of the body for allowing the body to be expanded to a working position and to be folded to a folded position.

The handle device includes a pair of posts having a lower portion secured to the base of the body, and a pair of tubes secured to the upper portion of the body and slidably engaged on the posts respectively for allowing the tubes and the upper portion of the body to be moved up and down along the posts.

The posts each includes an upper portion, the tubes each includes a lower portion, the handle device includes a bar secured to the upper portions of the posts and having a pair of orifices for slidably receiving the tubes, and a block secured to the upper portion of the body and secured to the lower portions of the tubes and slidably engaged on the posts for guiding the tubes to move up and down along the posts.

The handle device includes a pair of pipes slidably received in the tubes respectively and moved relative to the tubes between an extended position and a retracted position, and means for selectively securing the pipes at the extended position and the retracted position relative to the tubes.

The posts each includes a lower portion pivotally coupled to the base of the body at a pin for allowing the posts to be rotated relative to the base between an upright position and a lay down position, and means for securing the posts to the base at the upright position.

The posts each includes a frame secured to the lower portion thereof and pivotally secured to the base at the pin, the frames each includes an aperture formed therein, the base includes a pair of spring-biased projections engaged with the apertures of the frames respectively for securing the posts to the base at the upright position.

The frames each includes a recess formed therein for engaging with the spring-biased projection and for securing the posts to the base at the lay down position.

The posts each includes an oblong hole formed in the lower portion thereof, the handle device includes a pair of knobs each having a lateral pole slidably engaged in the oblong holes and each having a stick slidably engaged in the aperture for disengaging the spring-biased projection from the aperture and for allowing the posts to be rotated relative to the base about the pin.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
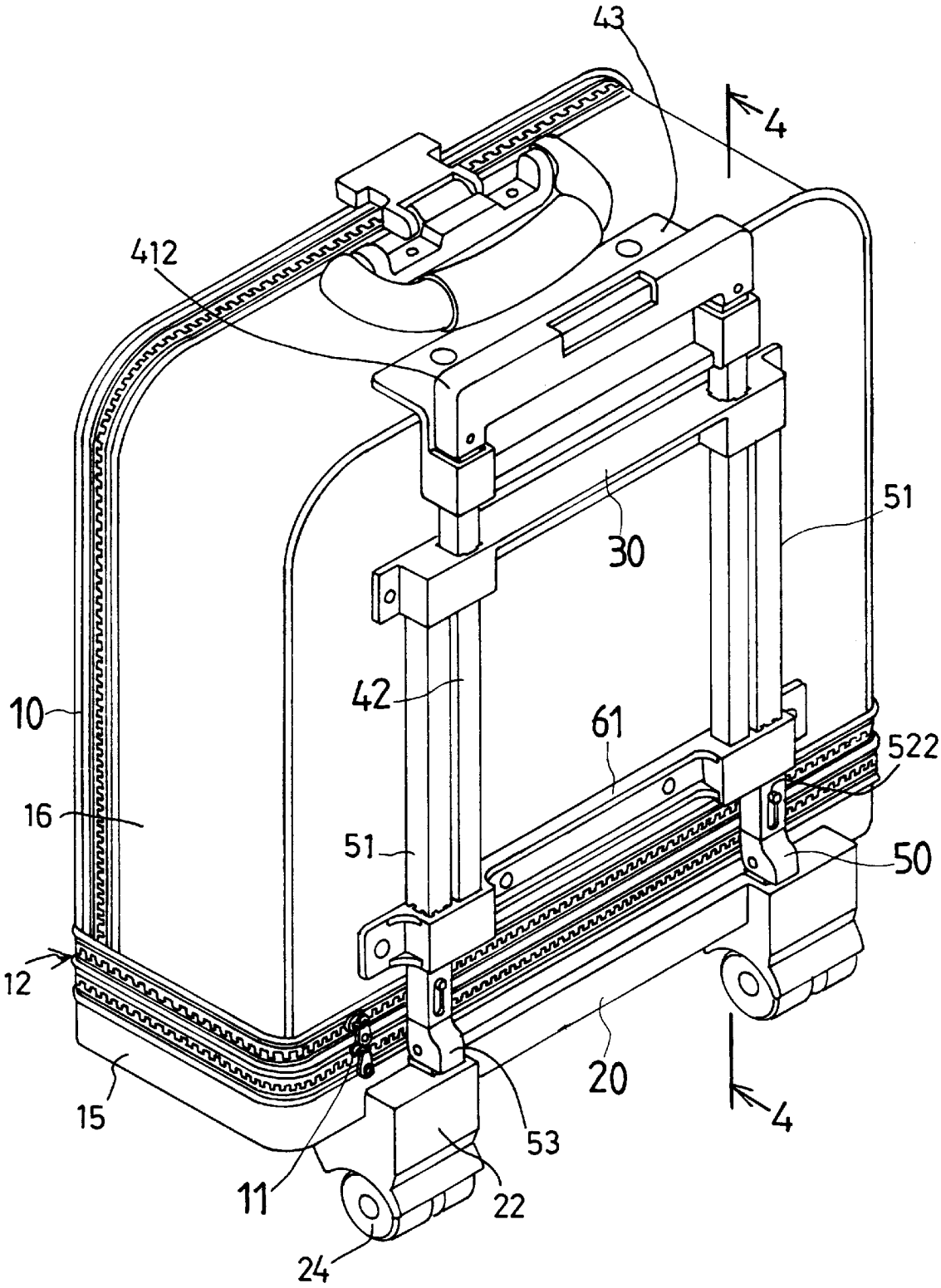
FIG. 1 is a perspective view of a luggage article in accordance with the present invention.
Figure 2:
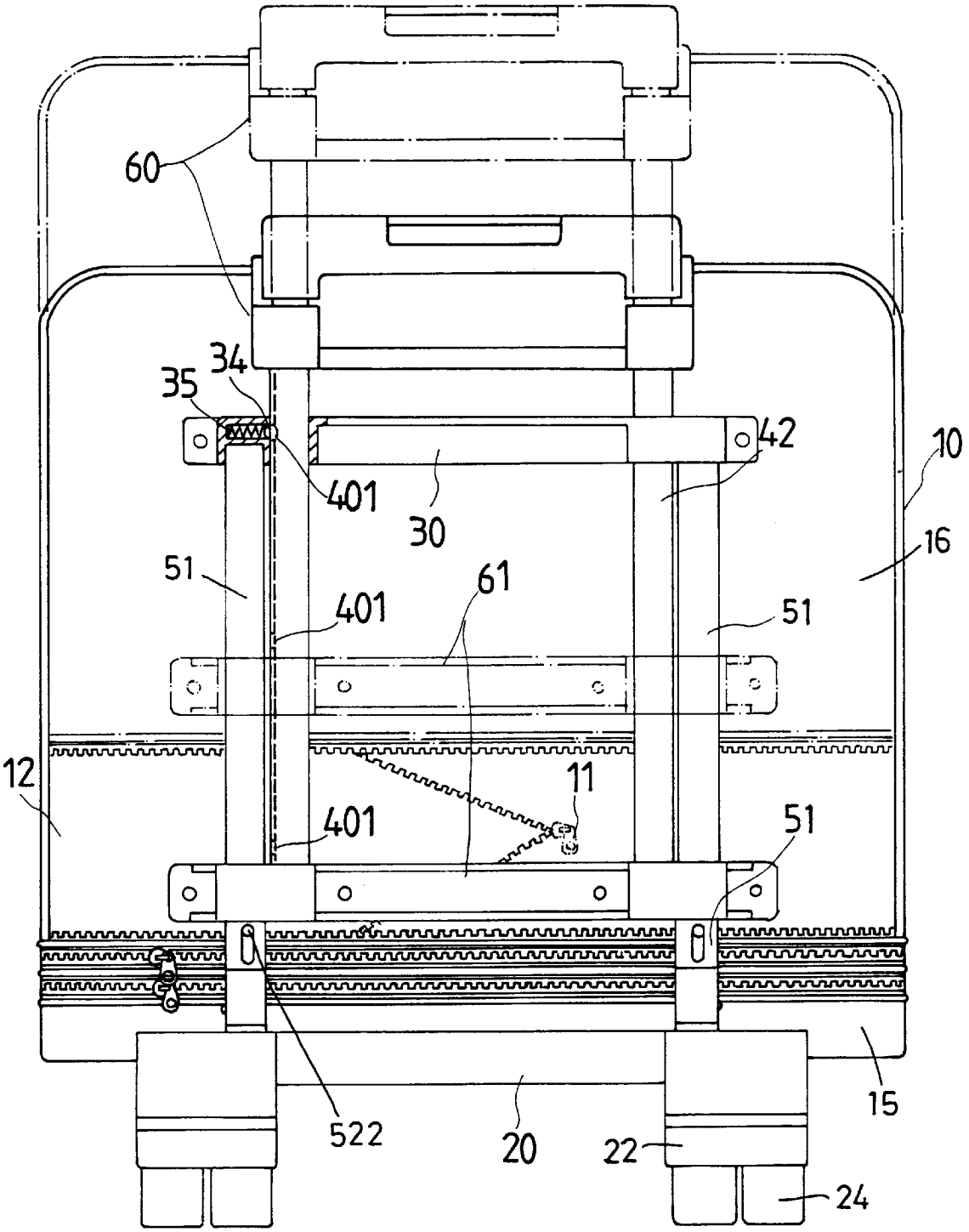
FIG. 2 is a rear view of the luggage article.
Figure 3:
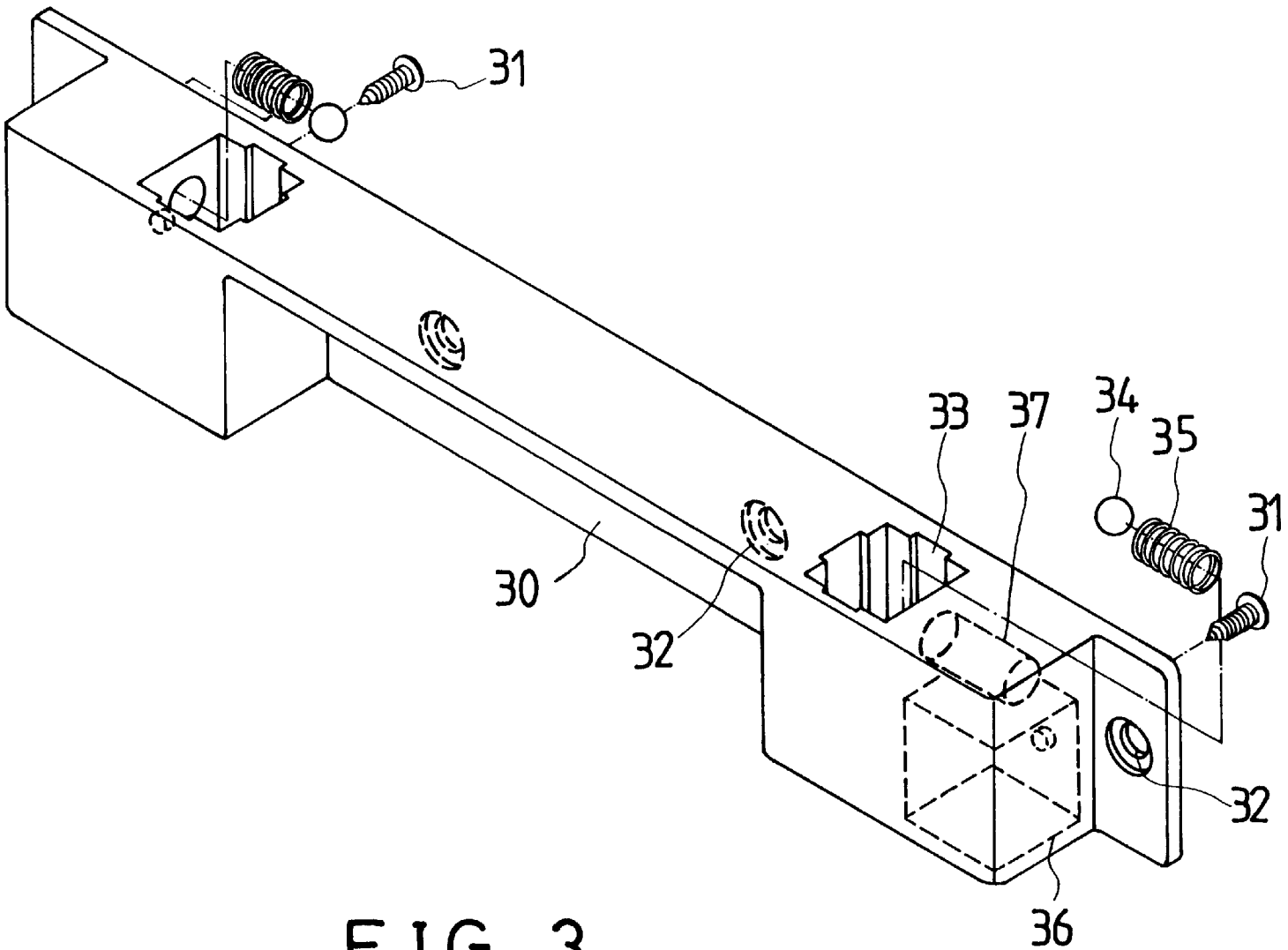
FIG. 3 is a partial exploded view of a bar.

Referring to the drawings, and initially to FIGS. 1–3, a luggage article in accordance with the present invention comprises a body 10 including a foldable middle portion 12 formed between the lower portion 15 and the upper portion 16. One or more peripheral or helical zipper devices 11 are provided in the foldable middle portion 12 for allowing the middle portion 12 to be secured in the folded position as shown in FIG. 1 by the zipper device 11 and to be opened or expanded to the working position as shown in FIG. 2. The foldable structure for the luggage article is typical and will not be described in further details. The present invention is to provide a retractable handle device that is attached to the foldable luggage article for allowing the luggage article to be supported in the expanded position by the handle device. A base 20 is secured to the lower portion 15 of the luggage article 10 for supporting one or more wheels 24 by one or more wheel cases 22. A pair of posts 51 have a lower end secured to the lower portion 15 of the body 10 and preferably secured to the wheel cases 22 at a foldable structure 50.

A bar 30 includes two depressions 36 for receiving the upper ends of the posts 51 and secured to the posts 51 by fasteners 31. The bar 30 is secured on top of the posts 51 and is not secured to the upper portion of the body 10 (FIGS. 1, 2). The bar 30 includes a pair of orifices 33 for slidably receiving a pair of tubes 42 respectively. A block 61 is secured to the bottom ends of the tubes 42 and secured to the upper portion 16 of the body 10 such that the upper portion 16 of the body 10 moves in concert with the tubes 42. It is preferable that the block 61 includes two holes for slidably receiving the posts 51 and for guiding the block 61 to move up and down relative to the posts 51. The upper portions of the tubes 42 are further secured together by a bracket 60 which is also secured to the upper portion 16 of the body 10, such that the tubes 42 may move upward along the posts 51 when the middle portion 12 of the body 10 is expanded. As shown in FIG. 3, the bar 30 includes one or two punctures 37 laterally formed therein for receiving a respective spring-biased projection that includes a spring 35 and a ball 34. The ball 34 is biased by the spring 35 to engage with either of the holes 401 of the tubes 42 (FIGS. 2, 6) and for securing the tubes 42 to the posts 51 and for securing the upper portion 16 of the body 10 relative to the base 20 and the posts 51 at the expanded working position or at the folded position.

Figure 4:
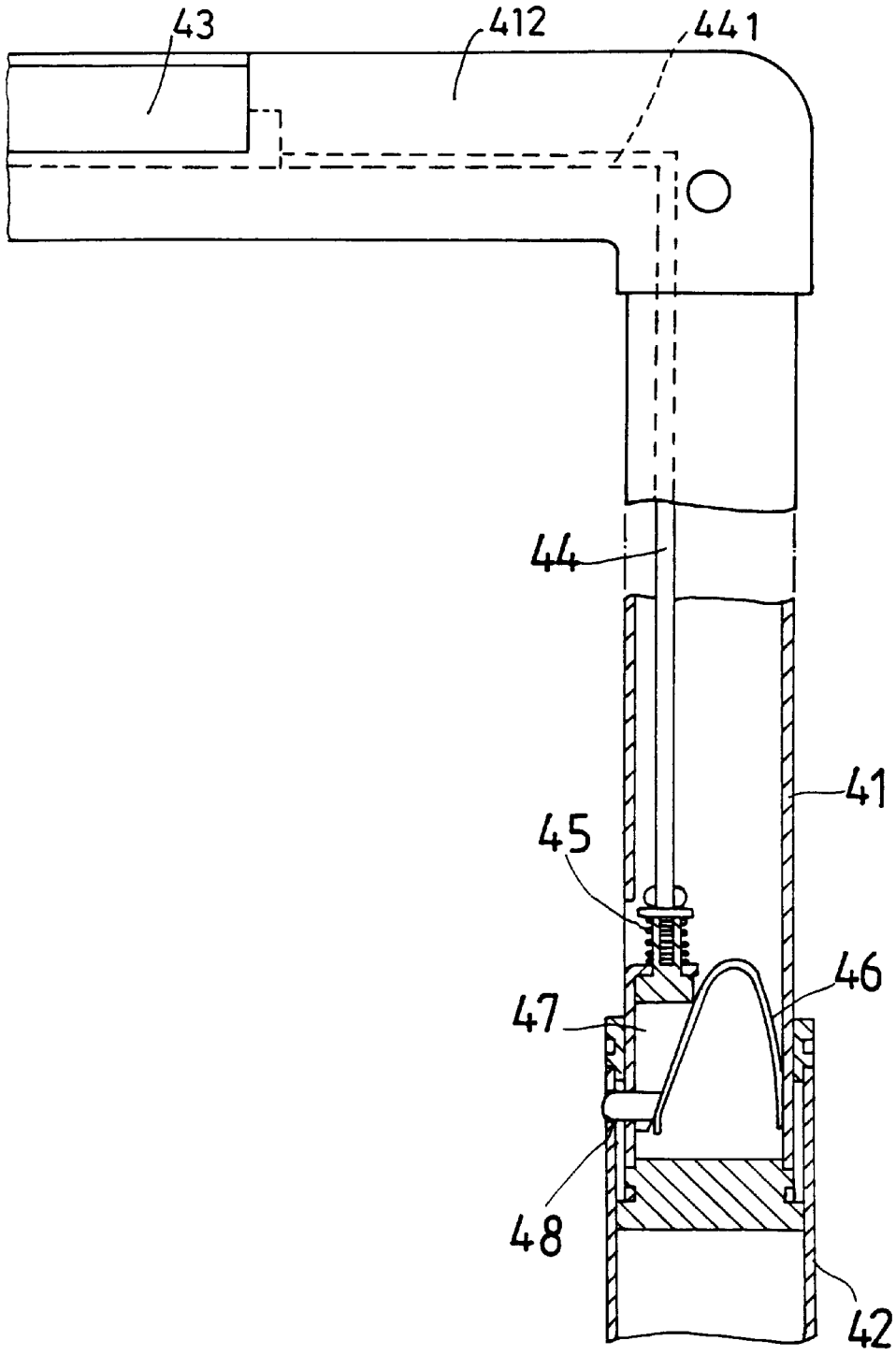
FIG. 4 is a partial cross sectional view taken along lines 4—4 of FIG. 1.
Figure 5:
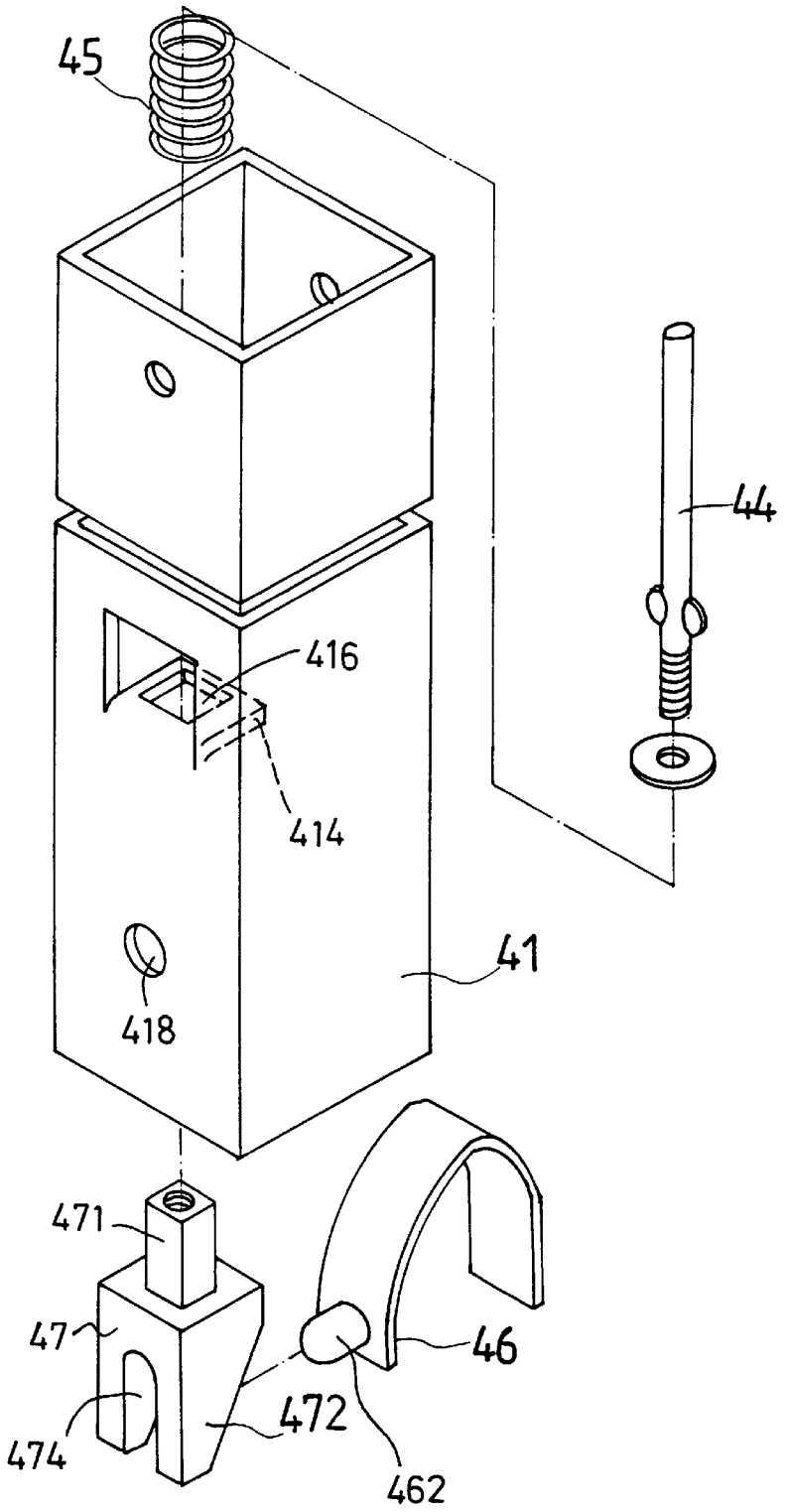
FIG. 5 is a partial exploded view of the retractable handle device.

As shown in FIGS. 4 and 5, two pipes 41 are slidably received in the tubes 42 respectively and have an upper portion secured together by a handle 412. A hand grip 43 is slidably received in the handle 412 and movable up and down relative to the handle 412. Two rods 44 are slidably received in the pipes 41 respectively and have an upper end secured to the hand grip 43 by a link 441 such that the rods 44 may be moved up and down by the hand grip 43. The pipes 41 each includes an ear 414 extended inward therefrom and having an opening 416 for slidably receiving an upward extension 471 of an actuator 47. The extensions 471 are secured to bottom of the respective rods 44 such that the actuators 47 may be moved by the hand grip 43. A spring 45 is engaged between the ear 414 of the pipe 41 and the rod 44 for biasing the actuator 47 to engage with the ear 414 of the pipe 41. A spring-biased latch 46 is received in each of the pipes 41 and includes a tongue 462 extended through a hole 418 of the respective pipe 41 for engaging with either of a number of orifices 48 of the respective tube 42 and for securing the pipes 41 to the tubes 42 at any suitable positions. The actuators 47 each includes a notch 474 for slidably receiving the tongue 462 and each includes a tapered surface 472 for engaging with the latch 46 and for disengaging the tongue 462 of the latch 46 from the orifice 48 of the tube 42 and for allowing the pipes 41 to be slided relative to the respective tubes 42 and thus for allowing the handle 412 to be extended away from the bracket 60 for increasing the length of the handle device.

Figure 6:
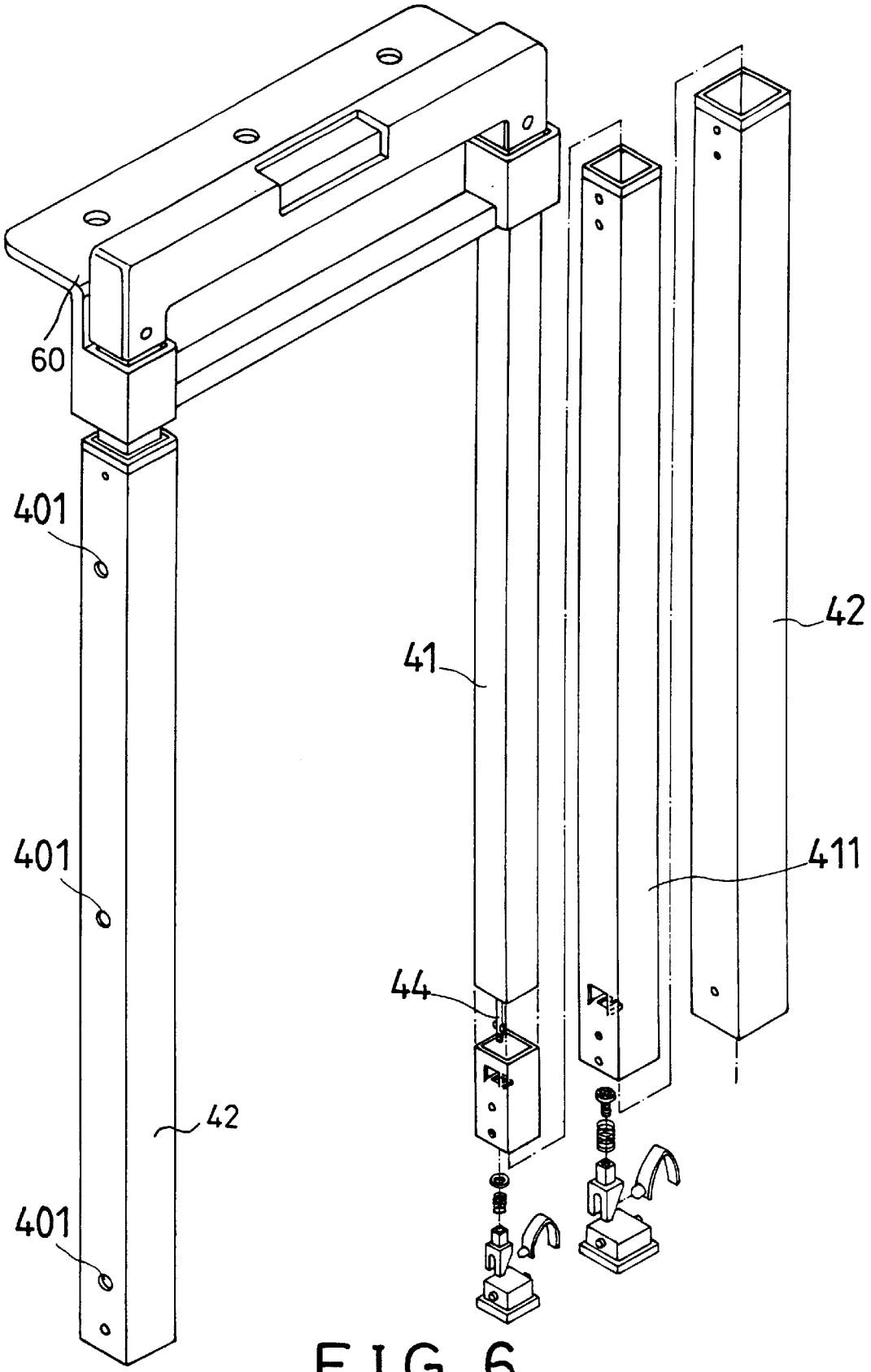
FIG. 6 is a partial exploded view illustrating another application of the retractable handle device.
Figure 7:
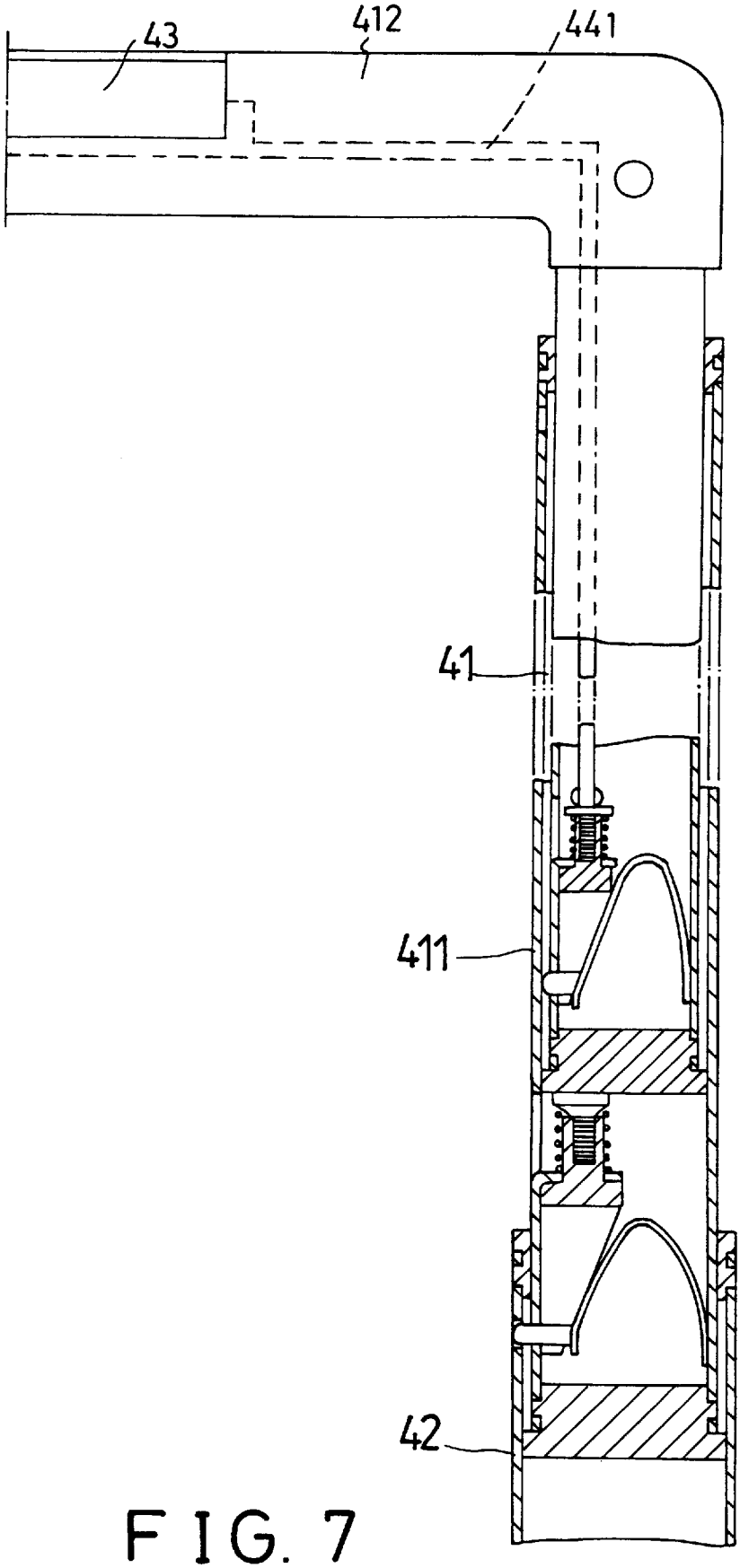
FIG. 7 is a partial cross sectional view of the retractable handle device as shown in FIG. 6.

Referring next to FIGS. 6 and 7, alternatively, a further intermediate duct 411 is slidably engaged between the respective tube 42 and pipe 41 for further increasing the extendible length of the handle device.

Figure 10:
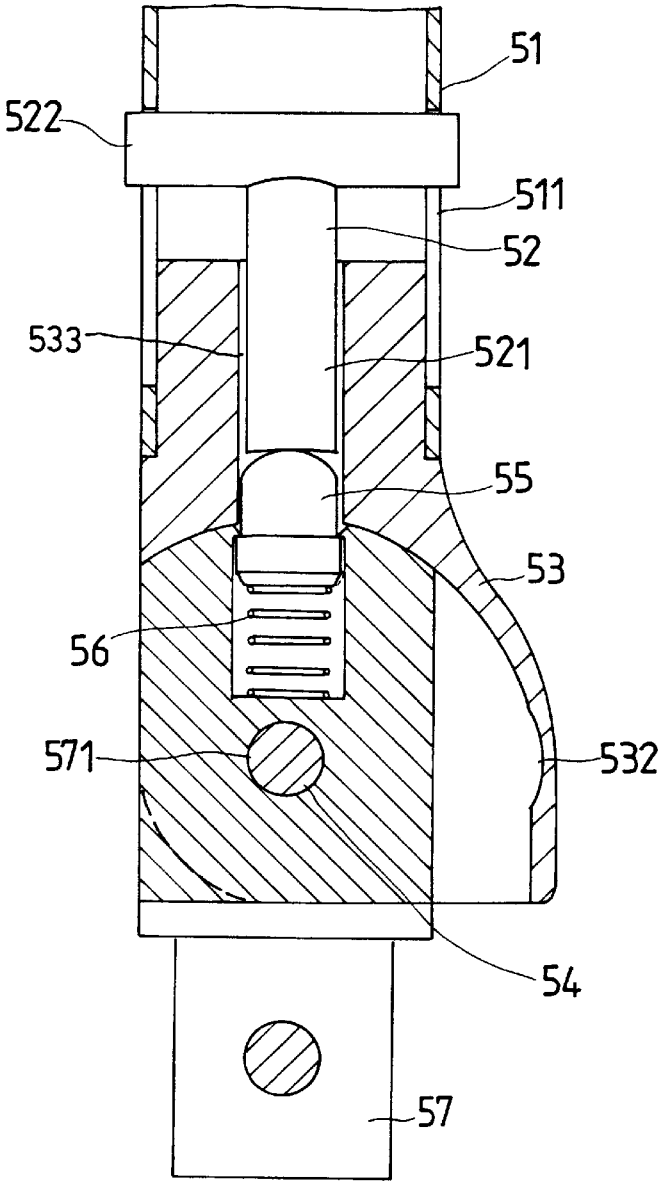
FIG. 10 is a cross sectional view taken along lines 10—10 of FIG. 8.
Figure 8:
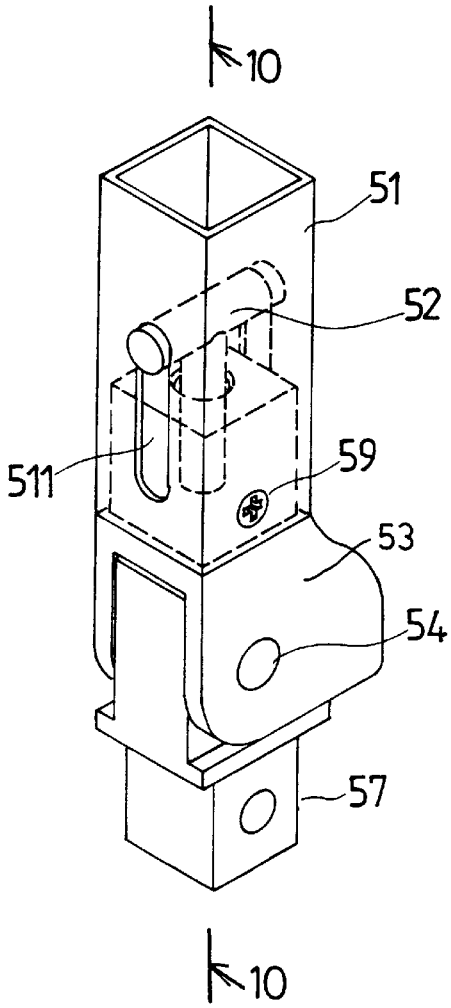
FIG. 8 is a partial perspective view of a foldable mechanism for the wheel.
Figure 9:
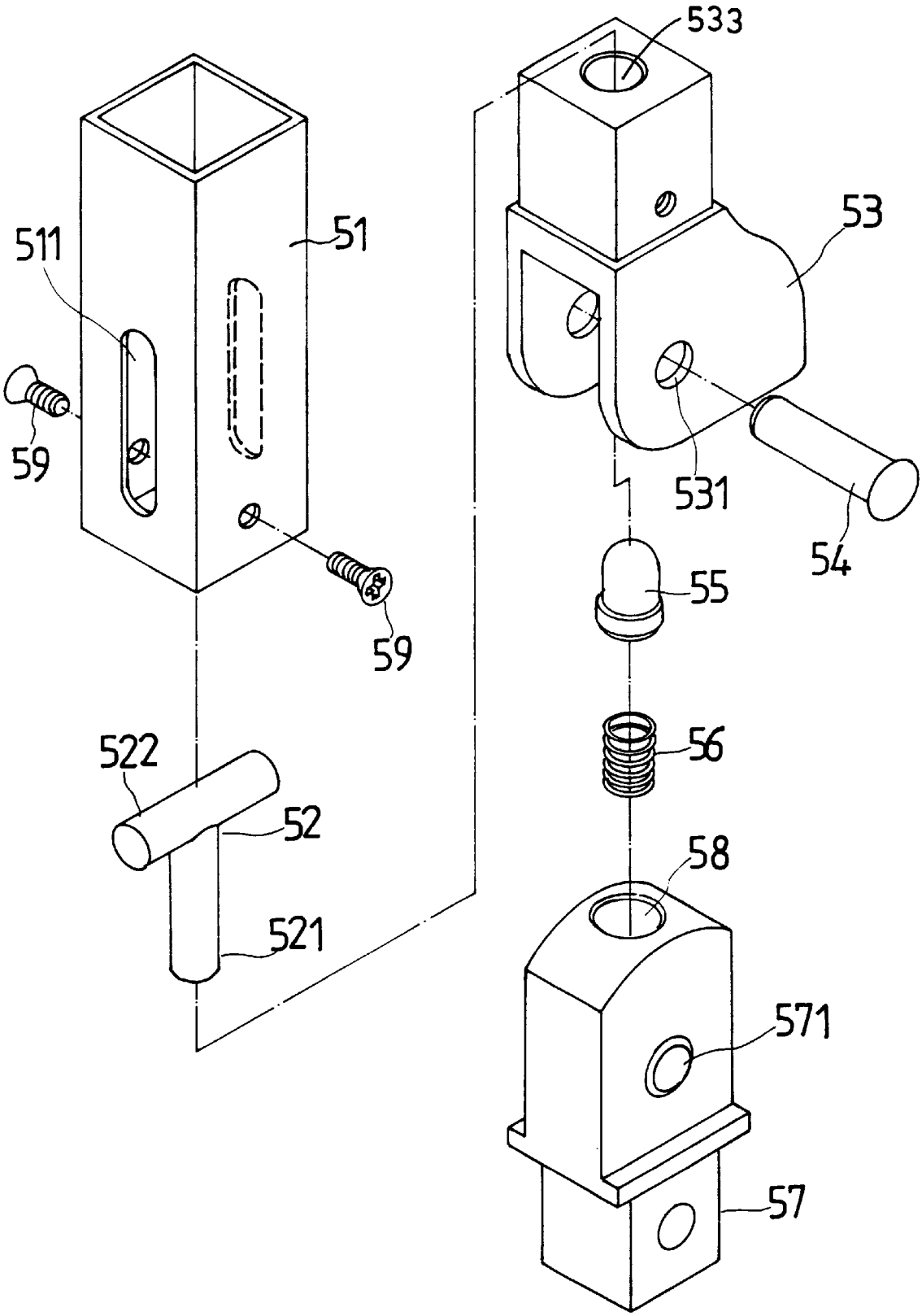
FIG. 9 is a partial exploded view of the foldable mechanism for the wheel.
Figure 11:
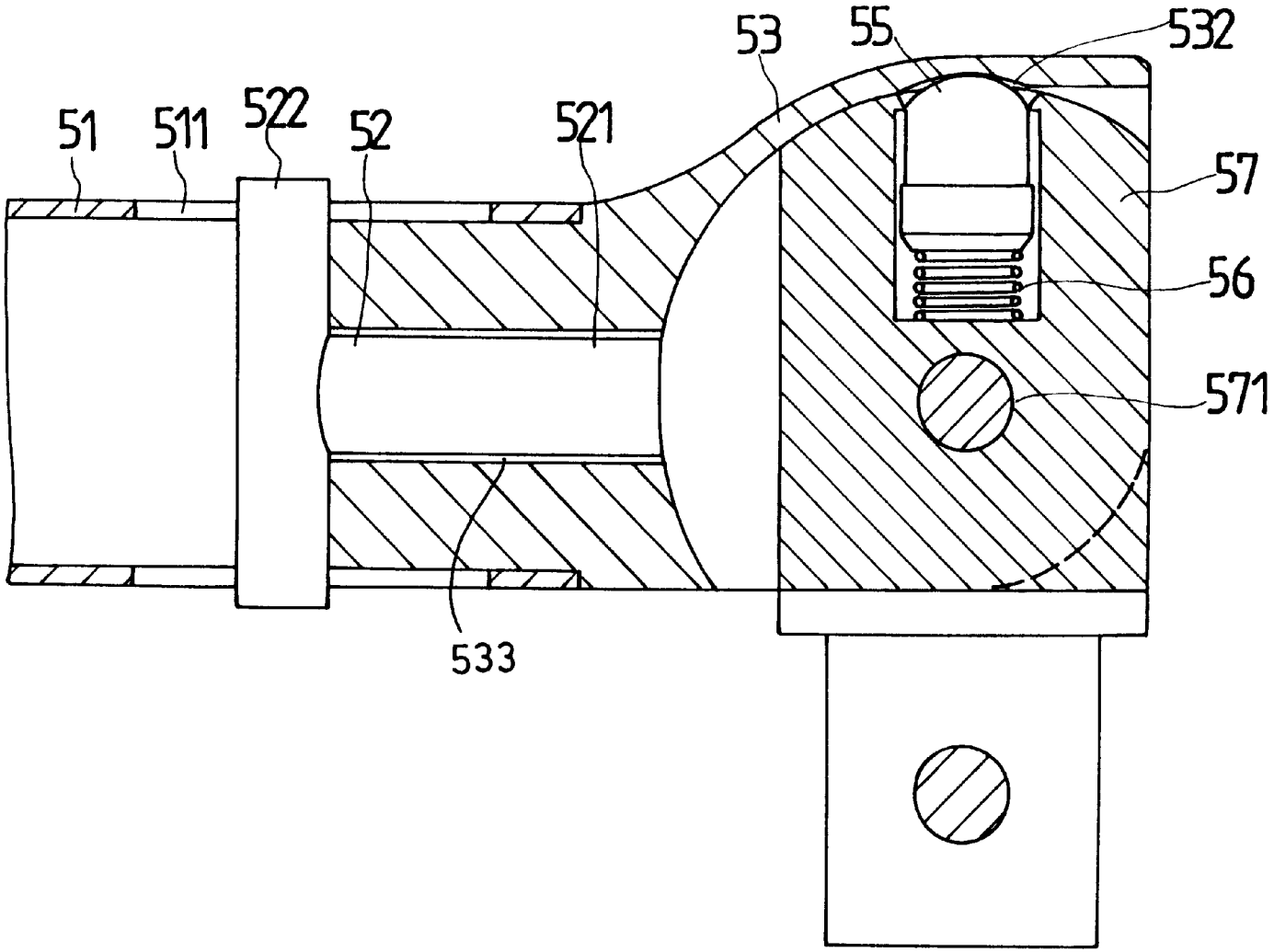
FIG. 11 is a cross sectional view similar to FIG. 10, illustrating the operation of the foldable mechanism for the wheel.

Referring next to FIGS. 8–11 and again to FIGS. 1 and 2, the posts 51 each includes a frame 53 secured to the bottom by fasteners 59 and each includes a pair of oblong holes 511 formed in the bottom portion. Two couplers 57 are secured to or extended from the base 20 and each includes a cavity 58 formed in the upper portion for receiving a spring-biased projection that includes a spring 56 and a catch 55. The frame 53 includes an aperture 533 formed in the upper portion and a recess 532 formed in the lower potion (FIGS. 10, 11) and is pivotally secured to the respective coupler 57 at a pin 54 which is engaged through a hole 571 of the coupler 57. The catch 55 is biased to engage with the aperture 533 (FIG. 10) for securing the post 51 at the upright position relative to the base 20 or with the recess 532 (FIG. 11) for securing the post 51 at the lay down position relative to the base 20. A knob 52 includes a lateral pole 522 slidably engaged in the oblong holes 511 and a stick 521 slidably received in the aperture 533 for disengaging the catch 55 from the aperture 533 when the pole 522 of the knob 52 is depressed downward against the spring 56 (FIG. 10). The pole 522 includes one or both ends extended outward of the posts 51 for allowing the knob 52 to be depressed against the spring 56. It is to be noted that the posts 51 and thus the tubes 42 may be rotated relative to the couplers 57 and thus the base 20 for allowing the luggage article 10 to be folded to a compact configuration when the luggage article 10 includes a soft and foldable structure.

Figure 12:
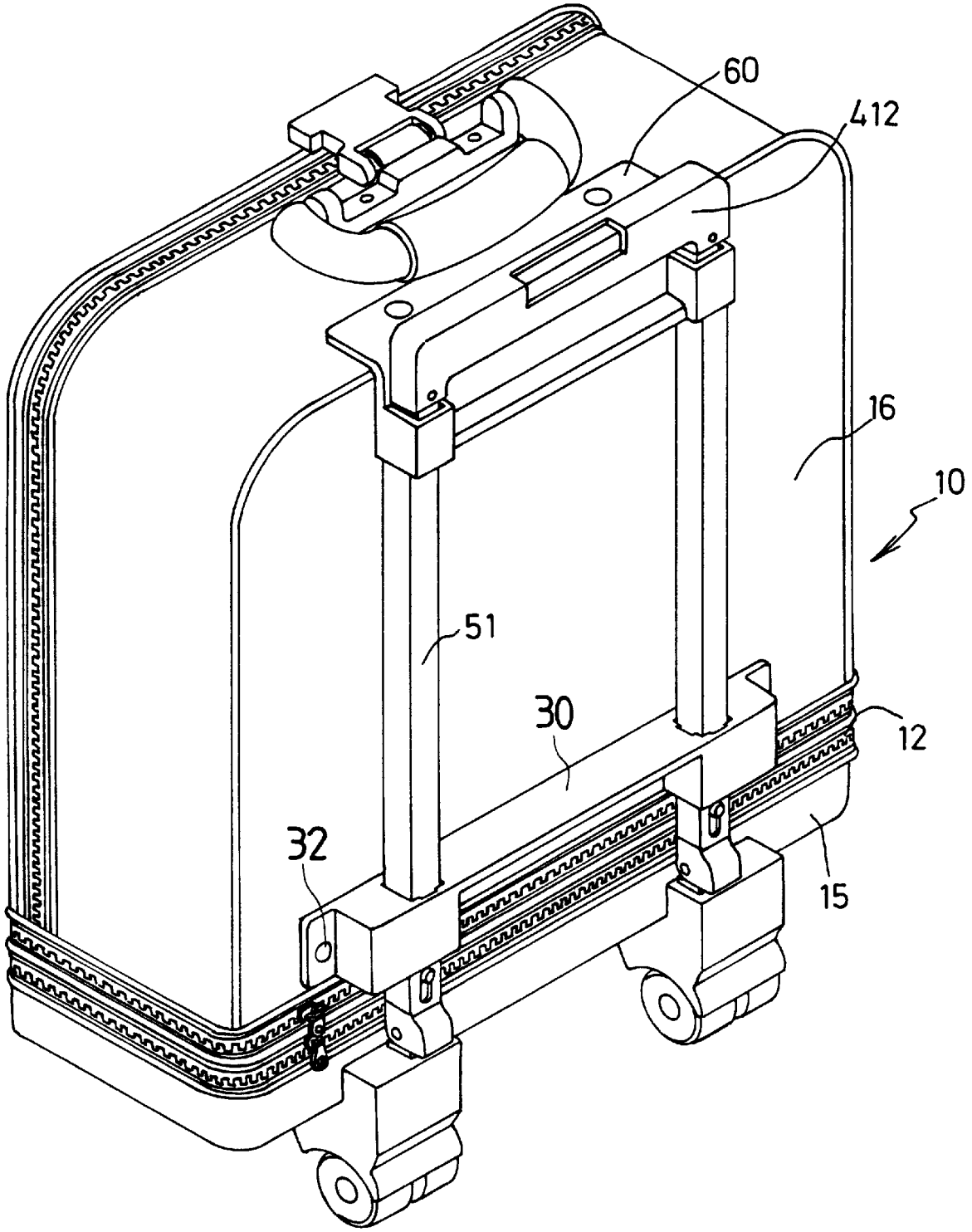
FIG. 12 is a perspective illustrating the other application of the luggage article.
Figure 13:
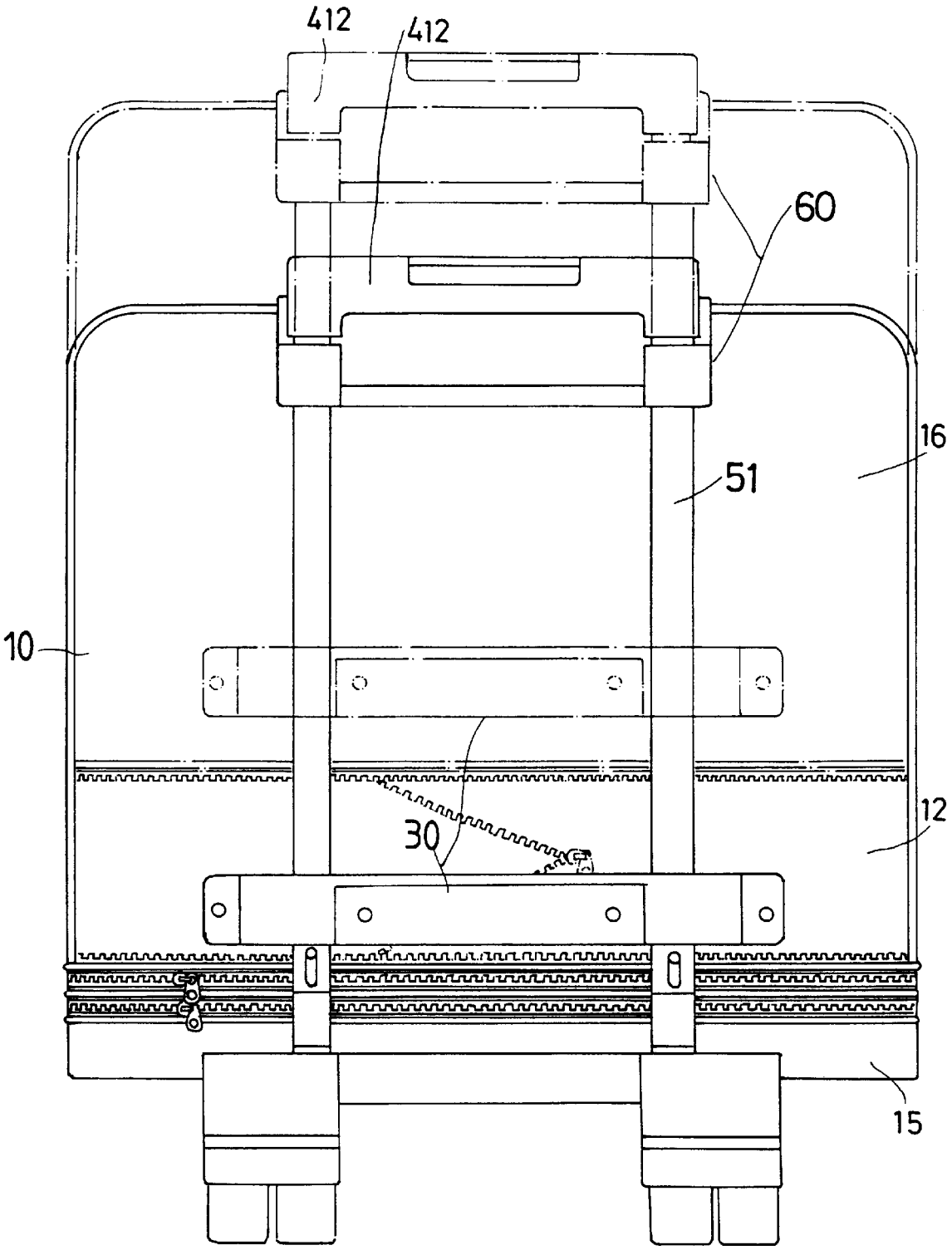
FIG. 13 is a rear view of the luggage article as shown in FIG. 12.

Referring next to FIGS. 12 and 13, alternatively, the bar 30 includes a number of holes 32 for receiving fasteners and for securing the bar 30 to the upper portion 16 of the body 10. The bar 30 is slidably engaged on the posts 51 and movable up and down along the posts 51. The handle 412 is secured to the bracket 60 and secured to the upper portion 16 of the body 10 such that the handle 412 and the upper portion 16 of the body 10 and the bar 30 may be moved or extended upward along the posts 51 to the expanded position.

Accordingly, the luggage article in accordance with the present invention includes a handle device that is extendible when the luggage article is opened and that is retractable when the luggage article is folded.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A luggage article comprising:

a luggage body including a base and an upper portion, and including a foldable middle portion provided between said base and said upper portion of said body for allowing said body to be expanded to a working position and to be folded to a folded position, a wheel device secured to said base of said body, a retractable handle device secured to said upper portion of said body, said handle device including a pair of posts having a lower portion secured to said base of said body and each having an upper portion, a bar secured to said upper portions of said posts and including a pair of orifices formed therein, a bracket secured to said upper portion of said luggage body, a pair of tubes including an upper portion secured to said bracket, and slidably engaged through said orifices of said bar respectively for allowing said tubes to be moved up and down relative to said posts, said tubes each including a lower portion, a block secured to said upper portion of said body and secured to said lower portions of said tubes and slidably engaged on said posts for guiding said tubes to move up and down relative to said posts, said block and said bracket and said tubes being allowed to be moved up relative to said posts for supporting said body at said working position and to be moved down relative to said posts for supporting said body at said folded position.

2. The luggage article according to claim 1, wherein said handle device includes a pair of pipes slidably received in said tubes respectively and moved relative to said tubes between an extended position and a retracted position, and means for selectively securing said pipes at said extended position and at said retracted position relative to said tubes.

* * * * *